US009759154B2

(12) United States Patent
Weber et al.

(10) Patent No.: US 9,759,154 B2
(45) Date of Patent: Sep. 12, 2017

(54) METHOD FOR COATING A BORE AND CYLINDER BLOCK OF AN INTERNAL COMBUSTION ENGINE

(71) Applicant: Ford Global Technologies, LLC, Dearborn, MI (US)

(72) Inventors: Carsten Weber, Leverkusen (DE); Jan Mehring, Cologne (DE); Kai Sebastian Kuhlbach, Bergisch Gladbach (DE); Urban Morawitz, Cologne (DE); Maik Broda, Würselen (DE); Clemens Maria Verpoort, Monheim am Rhein (DE)

(73) Assignee: Ford Global Technologies, LLC, Dearborn, MI (US)

( * ) Notice: Subject to any disclaimer, the term of this patent is extended or adjusted under 35 U.S.C. 154(b) by 259 days.

(21) Appl. No.: 14/614,154

(22) Filed: Feb. 4, 2015

(65) Prior Publication Data

US 2015/0219039 A1 Aug. 6, 2015

(30) Foreign Application Priority Data

Feb. 6, 2014 (DE) ..... 10 2014 202 134

(51) Int. Cl.

| | |
|---|---|
| ***F02F 1/18*** | (2006.01) |
| ***B05D 3/02*** | (2006.01) |
| ***B05D 3/12*** | (2006.01) |
| ***B05D 7/14*** | (2006.01) |
| ***C23D 5/00*** | (2006.01) |
| *B05D 1/02* | (2006.01) |
| *B05D 1/18* | (2006.01) |
| *B05D 7/22* | (2006.01) |
| *C23D 5/02* | (2006.01) |
| *F02B 77/02* | (2006.01) |

(52) U.S. Cl.

CPC ..... *F02F 1/18* (2013.01); *B05D 3/0254* (2013.01); *B05D 3/12* (2013.01); *B05D 7/14* (2013.01); *C23D 5/005* (2013.01); *B05D 1/02* (2013.01); *B05D 1/18* (2013.01); *B05D 7/22* (2013.01); *C23D 5/02* (2013.01); *F02B 77/02* (2013.01); *F05C 2253/12* (2013.01); *Y10T 29/49231* (2015.01)

(58) Field of Classification Search

CPC . F02F 1/18; C23D 5/005; F02B 77/02; B05D 3/0254

See application file for complete search history.

(56) References Cited

U.S. PATENT DOCUMENTS 3,061,482 A * 10/1962 Grant ..... C23C 24/00 148/281
6,001,494 A * 12/1999 Kuchinski ..... C03C 8/02 428/653
6,732,698 B1 * 5/2004 Bedwell ..... C21D 5/00 123/193.2
2008/0245227 A1 * 10/2008 Iizumi ..... B23B 27/007 92/169.1

FOREIGN PATENT DOCUMENTS

DE 102007023297 A1 2/2008

* cited by examiner

*Primary Examiner* — Kevin A Lathers
(74) *Attorney, Agent, or Firm* — Damian Porcari; McCoy Russell LLP

(57) ABSTRACT

A method of producing an enamel coating for a cylinder bore in a cylinder block of an internal combustion engine is provided. The method also provides for coating a cast iron gray cylinder block with an enamel coating.

11 Claims, 6 Drawing Sheets

METHOD FOR COATING A BORE AND CYLINDER BLOCK OF AN INTERNAL COMBUSTION ENGINE

CROSS REFERENCE TO RELATED APPLICATIONS

The present application claims priority to German Patent Application No. 102014202134.0, filed Feb. 6, 2014, the entire contents of which are hereby incorporated by reference for all purposes.

FIELD

The present disclosure relates to a method for producing a coated surface, in particular a cylinder bore of an internal combustion engine, and also to a cylinder block of an internal combustion engine.

BACKGROUND/SUMMARY

Cylinder bores located in the cylinder blocks of internal combustion engines may experience a significant tribological load, e.g., friction and wear, due to the sliding, linear motion of pistons therein. Furthermore, especially in diesel processes which may have lower combustion temperatures, thermal energy may be lost in the combustion cycle due to lack of thermal insulation in the cylinders to retain the thermal energy.

One example to address wear from friction is to produce metallic layers by thermal spray or plasma powder spray.

However, the inventors herein have recognized potential issues with such systems. One such issue is that there is not a cost-effective technique of applying thermal spray to a cylinder block comprising cast gray iron, for example, because of the need for a costly NiAl adhesive base. Further, current thermal spraying methods involve high velocity and high temperature treatment methods that may change material properties and may produce layers of continuous porosity which undergo corrosion through the infiltration of iron oxides, for example. Plasma spray coatings are based on Fe-material and do not have a thermal barrier effect. Further, layers produced by plasma powder spraying may not withstand the tribological and mechanical load present within a cylinder of an internal combustion engine, as the structures thereof may contain micro-cracks.

One potential approach to at least partially address some of the above issues includes a system and method of coating a cylinder bore. This method includes producing a cylinder body present in a blank, drilling out a bore and pre-machining the bore, applying an enamel coating to an inner surface of the bore, and, post-treating the coated bore, the enamel coating bonding to the base material of the bore metallurgically by phase formation. In one example, the enamel coating may be applied via a rotating apparatus or a floating apparatus.

In another example, the enamel coating is applied to a cast gray iron cylinder block, which may undergo heat treatment to bond the enamel coating and convert the cast gray iron to an austempered gray iron. In this way, a cylinder block is produced with improved mechanical properties and a cylinder bore is coated with an enamel coating which is corrosive resistant, reduces wear and friction, and provides thermal insulation in order to reduce the loss of thermal energy in the combustion cycle.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
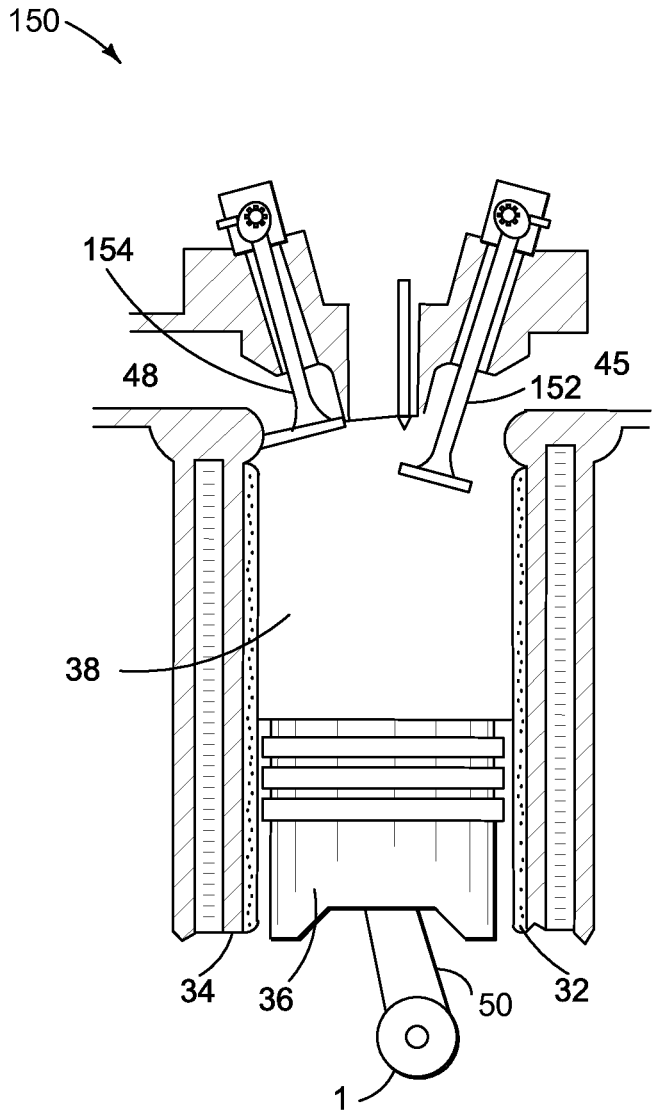
FIG. 1 schematically depicts an example cylinder bore with an enamel coating.

Cylinder bores of internal combustion engines should have a uniform and small clearance between the inner circumference thereof and pistons or piston rings moving to and fro therein, with ideal tribological conditions ideally being achieved.

DE 10 2007 023 297 A1 discloses that a two-stage method is to be provided, with the intention being that pre-machining is followed by precision machining. Before the second step for producing an out-of-round initial shape is started, e.g., before the precision machining is begun, DE 10 2007 023 297 A1 provides for the application of a sliding layer to the pre-machined initial shape. According to DE 10 2007 023 297 A1, this can be effected only by a thermal spraying method, with wire arc spraying, atmospheric plasma spraying, or high-velocity flame spraying being conceivable. Plasma powder spraying, too, may be a suitable spraying method. In this respect, DE 10 2007 023 297 A1 points out in particular that the layer thickness of the applied layer should not be smaller than at least 50 μm. In addition, the surface should be pre-treated thermally, mechanically, chemically, or in a manner assisted by a water jet before the coating.

In these thermal coating methods, molten coating particles impinge at a high temperature and at times at a very high velocity on the surface to be coated, in order to produce the thermally sprayed layer. This involves the disadvantage that the base material to be coated is subjected virtually to an uncontrolled heat treatment, such that the material properties thereof may change. In addition, the cylinder block in which the cylinder bore to be coated is arranged will be heated to a very high temperature, such that the further processing of the cylinder block is delayed for the duration of the necessary cooling phase.

Wear-resistant layers with tribological suitability can be produced by thermal spraying methods. However, coatings of this nature are not used in practice in engine blocks made of gray cast iron material (GCI material), because the honed GCI surface is itself already readily suitable in tribological terms on account of the graphite lamellae which are present with their self-lubricating action. Therefore, worn barrels in GCI engine blocks in particular are brought back into the original state by spraying on steel layers. It is then possible to establish the original diameter again by honing. It is known from such engines repaired by thermal spraying that they exhibit a lower oil consumption or higher power than engines which have been repaired by finish-honing of the bore and by the use of oversize pistons. This establishes further reduced friction between the piston ring and the porous thermally sprayed layer, with the pores acting as it were as an oil reservoir and providing additional oil for the piston ring particularly in the region of the piston turning points and therefore in the region of the mixed friction.

In the case of aluminum engine blocks (Al engine blocks), by contrast, the surface is to be activated and roughened before the coating, it being possible for this to take place, for example, by water jets or by mechanical roughening. Neither method is considered for GCI engine blocks, however, and therefore finish-honing with relatively high roughness combined with flex-honing or hammer brushing is necessary. In addition, a thin layer of costly NiAl adhesive base material has to be sprayed on thermally before the actual functional coating is applied by a thermal method. This two-stage process makes the coating costs for GCI engine blocks high, as a result of which the thermal spraying is disadvantaged here. By contrast, the costing for engine blocks made of Al material is more favorable: here, the liner made of GCI material can be dispensed with. Simple mechanical roughening of the soft Al material generates a roughness profile with an undercut, and therefore the coating can be thermally sprayed directly onto said roughened surface. The undercut gives rise to a very high adhesive strength even without any adhesive base.

However, the thermally sprayed layers demonstrate a flaw, for example, with respect to the problem of undercorrosion, e.g., if aggressive, contaminated fuels are used. In this case, it is necessary to use highly Cr-alloyed powders or wires as filler material for the thermal spray coating, as a result of which the production costs increase further. On account of the continuous porosity, it may then nevertheless be the case, however, that condensates or acids can attack the base material through the layer. Only through additional impregnation of the layers is it possible to prevent such undercorrosion problems.

Furthermore, thermal barrier layers can be produced for internal combustion engines or gas turbines by means of plasma powder spraying methods using Zr—O2 with yttrium oxide stabilization. Such layers produced by plasma powder spraying are distinguished by a low heat conduction even at very high temperatures of up to above 1100° C. On the other hand, such layers produced by plasma powder spraying cannot be subjected to mechanical loading on account of the fact that their layer structure contains microcracks, it being the case that thermal barrier layers of this type would not be suitable as a coating subject to tribological loading in the cylinder barrel.

In the light of these observations, methods for producing coated bore surfaces, in particular methods for coating the bore of a cylinder block of an internal combustion engine, continue to afford room for improvement.

It is pointed out that the features and measures specified individually in the following description may be combined with one another in any desired technically meaningful way and disclose further refinements of the invention. The description, in particular in conjunction with the figures, characterizes and specifies the invention and its parts further.

What is presented hereinbelow according to the disclosure is a method for producing a coated surface, in particular a bore of an internal combustion engine, said method comprising at least the steps of producing a main body present in the blank; drilling out the bore and pre-machining the bore; applying an enamel coating to the inner surface of the bore, and post-treating the coated bore, the enamel coating bonding to the base material of the bore metallurgically by phase formation.

The enamel coating applied to the inner surface of the bore has a particularly good thermal insulation property and particularly good tribological properties. In addition, undercorrosion is reliably avoided, it being possible to dispense with costly additives such as, for example, zirconium oxide/yttrium oxide. In this respect, provision is expediently made of a method in which a suitable coating satisfies all requirements in terms of reliable operation of the component with minimal production costs, with it also being possible, however, for the method according to the present disclosure to be simultaneously integrated into the existing production chain for producing the engine blocks without major problems.

The enamel coating according to the present disclosure is preferably a fusion mixture. At the enamel temperature, the glass-forming oxides fuse together to form a glass melt. Glass-forming oxides here can be SiO2, B2O3, Na2O, K2O and Al2O3. Base enamels comprise approximately 23-34% by weight borax, 28-52% by weight feldspar, 5-20% by weight quartz, approximately 5% by weight fluoride, remainder soda and sodium nitrate. The oxides of Ti, Zr and Mo can serve as opacifier.

In order to achieve the effect that the enamel coating bonds firmly to the metallic substrate, i.e. to the base material, provision is made for example of constituents of cobalt, manganese or nickel oxides. It is also possible to use ceramic pigments, such as for example iron oxides, chromium oxides and spinels.

In one example, said substances are finely ground and melted. The molten mass is quenched, that is to say preferably introduced into water, with the granular vitreous frit thus produced being finely ground again in the subsequent step. By way of example, 30% to 40% water together with clay and quartz powder are added to the grinding operation. Depending on the nature of the enamel, the opacifiers and coloring oxides mentioned are also added.

This forms an enamel slip which, for better mixing, should rest for a certain amount of time, preferably for a few days, before the enamel slip is to be used again. The use of suitable modifiers ensures that there is a uniform layer thickness, for example after dip coating, with possible dip coating with a flooding apparatus being dealt with in more detail hereinbelow.

Different procedures can be chosen for applying the enamel coating, e.g., the enamel slip. On the one hand, the aqueous enamel slip can be applied by a rotating apparatus, which, while rotating about its vertical axis in the vertical direction of the bore, can be moved to and fro therein. The apparatus can be in the form of a lance, it being possible for the material to be applied in a plurality of passes, i.e. layers. At its application end, the lance expediently has at least one outlet opening, from which the enamel slip can emerge. The enamel slip is, so to speak, flung onto the surface to be coated by the rotation. It is of course also possible for provision to be made of a plurality of outlet openings, which can be arranged on the lance as seen in the circumferential direction and also in the vertical direction thereof. In one example, provision can be made firstly to apply a specific material thickness, which is then dried, before the next layer, i.e. further material, is applied. This layer can be dried, for example, with an induction coil. It is of course also possible for provision to be made to apply the enamel coating in a single step.

As already mentioned, on the other hand the enamel coating can also be applied in a dipping operation, however. For this purpose, in one example, the entire cylinder block, in which there are one or more bores to be coated, can be introduced with the head side thereof first into the enamel slip bath. It is also inevitably the case here that the exterior of the cylinder block is coated, but this is disadvantageous in respect of reducing the amount of material. It is expedient, however, if the bore is flooded with the enamel slip, this likewise being referred to as a dipping operation with a flooding apparatus within the context of the present disclosure. In this case, the entire cylinder block is placed with the head side thereof first on a flooding apparatus. The flooding apparatus expediently has at least one chamber which has at least one outlet opening, with a feed opening also being provided. A line is connected to the feed opening and carries the enamel slip to the flooding apparatus such that there is such a pressure therein, i.e. in the chamber, that the enamel slip enters into the bore to be coated from below from the outlet opening. It is expedient that sealing elements, e.g. in the refinement in the form of a sealing lip, are also provided on the flooding apparatus, it being possible for the wall of the bore to be coated to bear against said sealing elements in the circumferential direction, such that the bore is sealed off with respect to the flooding apparatus over its wall. The entire bore, i.e. the inner surface thereof, is thus coated with the enamel slip. In this case, it is equally possible to provide a multi-stage layer build-up with the optional, aforementioned intermediate drying of individual partial layers as well as the application of the enamel coating in one step. The bore is thus flooded from the bottom upward. It is of course possible to flood the bore with the enamel slip from the top downward. For this purpose, the enamel slip is introduced into the bore open at the top, this likewise being considered to be a dipping operation within the context of the present disclosure.

It is expedient if the entire bore is provided with the enamel coating both over its entire circumference and over the entire vertical extent.

It is also expedient if the main body, i.e. the cylinder block, is produced from gray cast iron, with the sand casting method being suitable as the production method. This is generally known, and therefore no further details in this respect are provided. The bore, i.e. the cylinder bore, is then drilled out and pre-machined, the bore being drilled out to an oversize of 1 to 2 mm in diameter by finish-boring. For example, after OP10 machining, the cylinder bores are pre-machined with a diameter that is 1-2 mm larger than the final honed diameter. It is expedient within the context of the present disclosure if the surface in the region of the bore, i.e. the inner bore surface, is provided with a roughness of Ra 6 to 7 μm by turning spindles.

After this pre-machining, the enamel coating is applied. The enamel coating is applied as an aqueous suspension and then dried in a continuous furnace, e.g., at T=90° C. for approximately 10 minutes. Drying by a radiant heater or heating by the aforementioned induction coil is also possible. Then, the components are preferably annealed in a continuous furnace at T=840° C. for 10 minutes, such that the enamel coating can bond to the GCI substrate material of the cylinder block metallurgically by phase formation. This firing operation gives rise to the formation of a dense, closed oxide coating which is very resistant to corrosive attack by condensates or aggressive alternative fuels. The enamel coatings according to the present disclosure are distinguished from electroplating coatings or thermally sprayed coatings in that they cannot be infiltrated. If sprayed layers applied thermally are infiltrated, a Fe oxide phase can form under the coating, leading to a large increase in volume, associated with spalling of the thermally sprayed coating. The enamel coating according to the present disclosure, by contrast, cannot undergo further damage if the layer is removed down to the base material by local damage. Rust damage will then arise only in the region in which the enamel layer is absent, but this does not spread further.

In addition to this good corrosion resistance, the enamel coating according to the present disclosure is distinguished by a good wear resistance on account of the high layer hardness, typically of 600-800 HV0.1. This represents a hardness three times higher than that in the case of the GCI base material.

In a further procedure for producing the enamel coating, provision is expediently made to carry out a further heat treatment. For this purpose, the cylinder block with the dried enamel coating is heated to 800-900° C. in a protective gas furnace and held at this temperature for approximately 10-20 minutes. This is followed by rapid cooling, preferably in a salt melt, such that the cylinder block has a considerably higher strength than in the case of the conventional GCI material. It is surprising that the enamel firing treatment and this heat treatment proceed in the same temperature/time window, and this is utilized by the present disclosure. In this respect, the enamel firing treatment and this heat treatment are combined with one another, such that this firing and quenching operation thus gives rise to a cylinder block having an increased mechanical strength and also a cylinder bore with good thermal insulation and good wear and corrosion resistance. The heat treatment is expediently to be carried out as a bainitic gray cast iron heat treatment (AGI heat treatment=Austempered Gray Iron heat treatment).

After the firing of the enamel coating, the engine blocks are finish-machined and honed to final dimensions in the barrel.

Layer thicknesses of 500-1000 μm are preferably applied. The thicker the enamel coating, the greater the thermal insulation action thereof. This thermal insulation arises through the use of oxides such as Si, Ti, and Ca oxides, but also through the typical air bubble inclusions in the solidified glass matrix. This hard and brittle layer can be machined very easily by diamond honing strips, with these air bubbles being cut and exposed. Emphasis should be placed in particular on the fact that this does not involve pores or pore clusters which are connected to one another, as in the case of a sprayed coating applied thermally, and therefore a high hydrodynamic pressure can build up in the pores of the enamel coating according to the present disclosure and the oil film cannot be pressed away into connected pores by the piston ring.

On account of the outstanding corrosion and wear resistance, good thermal insulation and also the good friction behavior, the method according to the present disclosure is suitable for coating cylinder barrels of internal combustion engines. In addition, the firing cycle of the enamel coating can be combined with the AGI heat treatment, such that the cylinder block then has a higher strength. The composition of the enamel coating can be adapted by the addition of hard carbides in such a way that the wear resistance can be raised, e.g. for use in supercharged engines. In contrast to Zr oxide powder (currently 60 €/kg and the use of the expensive powder plasma spraying method), wet slipping of enamels (currently 2-4 €/kg) is very cost-effective.

The present disclosure therefore provides a method for producing a wear-resistant and corrosion-resistant coating within the bore of a cylinder block of an internal combustion engine made of gray cast iron material. According to the present disclosure, this coating satisfies at least the following requirements: as a consequence of the low thermal conductivity, it reduces the heat loss in the combustion process and thereby makes it possible to utilize the heat in the combustion process better in terms of thermodynamics in order to achieve a higher degree of efficiency. In addition, however, this coating also has good tribological properties, in order to stand up to the frictional wear conditions of the piston group. These requirements are satisfied according to the present disclosure by the firing of the, possibly hard, enamel coating. Furthermore, it is the case according to the present disclosure that the required firing treatment of the enamel coating is combined with the AGI heat treatment, and therefore only very low costs arise for this enameling and, at the same time, the cylinder block is given a higher strength than a cylinder block made of conventional GCI material. It is also conceivable to provide a cylinder block made of aluminum, i.e. the cylinder barrel thereof, with the enamel coating.

Optionally, the surface of the enamel coating can also be subjected to a final treatment, i.e. finishing, after the firing step. Provision is preferably made to machine the friction surfaces by turning and to remove the layer of scale which was formed on account of the annealing process. It is also possible to post-machine the bore by post-grinding, in which case it is possible to use diamond or hard material cup wheels. It is conceivable to perform post-machining by hollow turning or finish-boring, which is feasible in spite of the high hardness on account of the brittleness, with preference being given to PCD (polycrystalline diamond) indexable inserts.

Further advantageous details and effects of the present disclosure will be explained in more detail below on the basis of various exemplary embodiments illustrated in the figures.

In the different figures, identical parts are always provided with the same reference signs, and so said parts are generally also described only once.

Referring now to FIG. 1 an example cylinder is depicted at 150. Cylinder 150 may be one of the cylinders of an internal combustion engine, wherein the cylinders may be of any number or configuration found in an internal combustion engine. Basic components of cylinder 150 include the combustion chamber 38. Combustion chamber 38 is where a fuel air mixture is allowed into the chamber by intake valve 154 via intake port 48. Combustion of the air-fuel mixture in combustion chamber 38 forces piston 36 down along cylinder walls 34. The cylinder walls may comprise a base material such as a magnesium alloy, an aluminum alloy, gray cast iron, or cast steel. In another example, the cylinder walls may comprise austempered gray iron, as disclosed in the treatment method herein. The cylinder walls may be coated with an enamel coating 32, such that the enamel is metallurgically bonded by phase formation, with the material of the cylinder walls/bore. This bond may occur when the enamel coating undergoes phase formation when it is sintered, or annealed, onto the cylinder wall as disclosed in the present application. In one example, the enamel coating comprises at least one of the glass-forming oxides selected from the group consisting of $SiO_2$, $B_2O_3$, $Na_2O$, $K_2O$ and $Al_2O_3$. The enamel coating may further comprise components as described above. The enamel coating may comprise air bubble/pores, wherein the coating is applied with methods described herein such that the enamel coating may not have continuous porosity. Furthermore, there may be no NiAl-bond coating or layer in between the base material and the enamel coating.

Linear movement of piston 36 is translated to rotary motion of crankshaft 1 via connecting rod 50 acting on a crank arm. Combustion products leave combustion chamber 38 through exhaust port 45 when exhaust valve 152 is open. For the system and method of the present disclosure, the internal combustion engine may be a compression ignition or spark ignition and can combust gasoline, ethanol, diesel, or other fuel. The enamel coating in the present disclosure provides friction and wear resistance to the cylinder bore, as well as thermal insulation to reduce the loss of thermal energy and increase efficiency in the combustion process.

Figure 2:
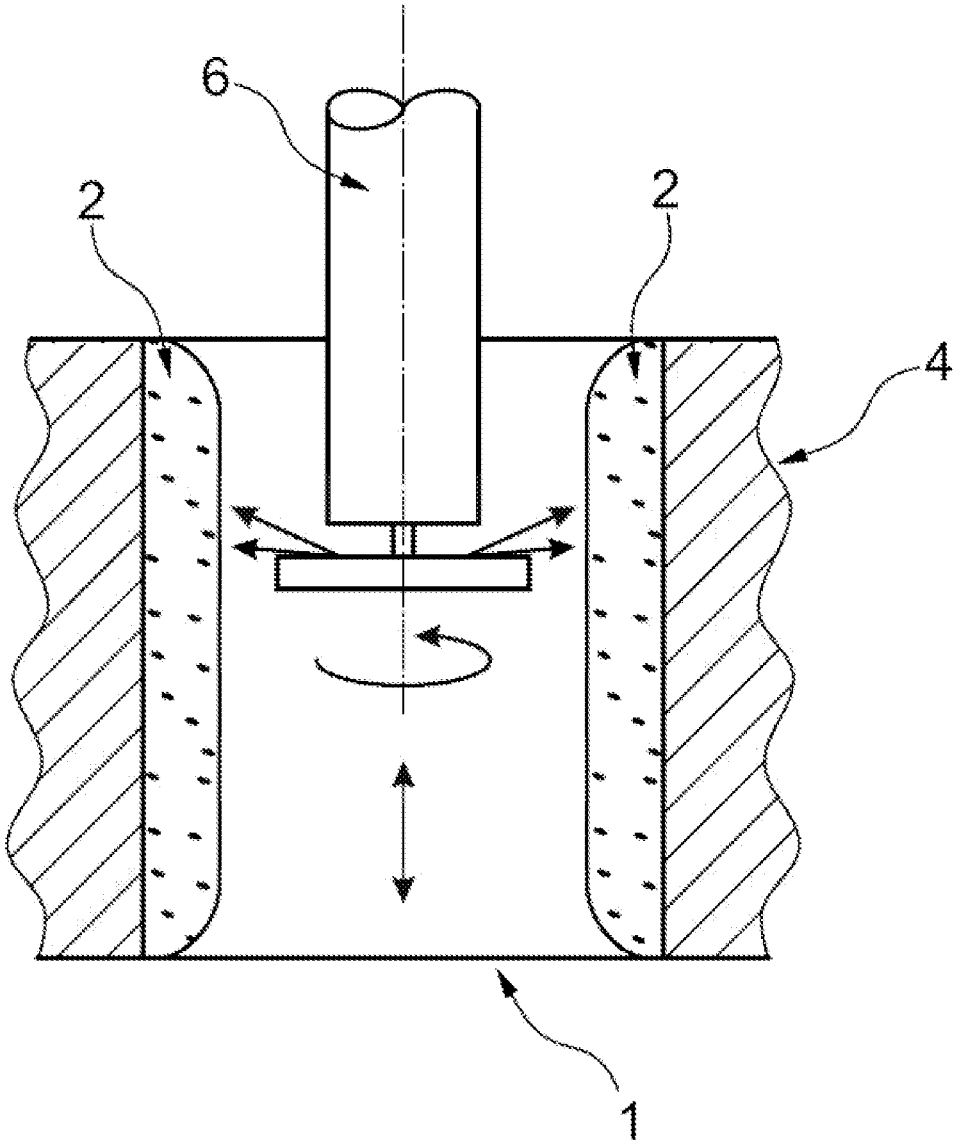
FIG. 2 shows a procedure for coating a bore with an enamel coating.

FIG. 2 shows a method for coating a bore 1 with an enamel coating 2. The bore 1 is made in a cylinder block 3, which can be seen in the form of a basic diagram in FIG. 3. In FIG. 2, the only part of the cylinder block 3 which can be seen is the inner surface 4 of the bore 1.

The cylinder block 3 was produced as a main body 3 from gray cast iron in a sand casting method. The bore 1 was drilled out to an oversize of 1 to 2 mm in diameter by finish-boring. The surface 4 in the region of the bore 1 was moreover provided with a roughness of Ra 6 to 7 μm by turning spindles.

The values given are of course mentioned merely by way of example. According to the current application, the bore 1 is provided with an enamel coating 2.

In the exemplary embodiment shown in FIG. 2, the enamel coating 2 is applied in the form of an aqueous enamel slip by means of a rotating apparatus 6, which, while rotating about its axis in the vertical direction of the bore 2, can be moved to and fro therein. The arrows of motion in terms of rotation and to and fro movement are shown in FIG. 2. The apparatus 6 can be referred to as a lance 6, it being possible for the material, i.e. the aqueous enamel slip, to be applied in a plurality of passes, i.e. layers. In one example, provision can be made firstly to apply a specific material thickness, which is then dried, before the next layer, i.e. further material, is applied. This layer can be dried, for example, with an induction coil. It is of course also possible for provision to be made to apply the enamel coating in a single step.

Figure 3:
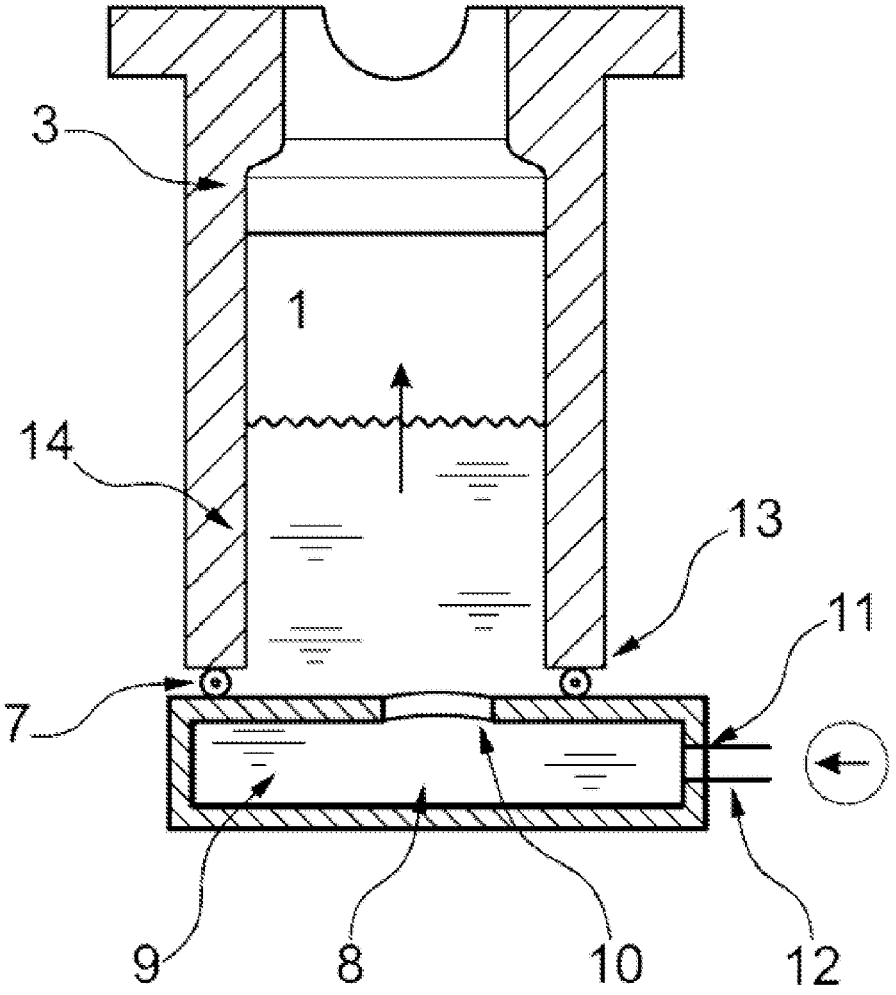
FIG. 3 shows a further procedure for coating a bore with an enamel coating.

As can be gathered from FIG. 3, on the other hand the enamel coating 2 can also be applied in a dipping operation, however. It can be seen in FIG. 3 that the bore 1 is flooded with the enamel slip from below, this being referred to as a dipping operation within the context of the current application. In this case, the entire cylinder block 3 is placed with the head side 7 thereof upright on a flooding apparatus 8, wherein the head side is the side of the cylinder block which will be coupled to a cylinder head The flooding apparatus 8 expediently has at least one chamber 9 which has an outlet opening 10, with a feed opening 11 being provided. A line 12 is connected to the feed opening 11 and carries the enamel slip to the flooding apparatus 8 such that there is such a pressure therein, i.e. in the chamber 9, that the enamel slip enters into the bore 1 to be coated from below from the outlet opening 10. It is expedient that sealing elements 13, e.g. in the refinement in the form of a sealing lip 13, are also provided on the flooding apparatus 8, it being possible for the wall 14, i.e. on the end side thereof, of the bore 1 to be coated to bear against said sealing elements 13 in the circumferential direction, such that the bore 1 is sealed off with respect to the flooding apparatus 8 over its wall 14. The entire bore 1, i.e. the inner surface 4 thereof, is thus coated with the enamel slip. In this case, it is equally possible to provide a multi-stage layer build-up with the optional, aforementioned intermediate drying of individual partial layers as well as the application of the enamel coating in one step.

In the view chosen in FIG. 3, merely a chamber 9 of the flooding apparatus 8 can be seen. The internal combustion engine, i.e. the cylinder block 3, possibly has more than one cylinder bore 1, however, this lying within the context of the current application. In this respect, the flooding apparatus 8 can also have more than the visible one chamber 9, and these can be arranged one behind another and/or alongside one another. This is dependent upon the type of internal combustion engine, e.g. as an in-line engine or as a V-type engine. It is of course also possible for a separate flooding apparatus 8 with a single chamber 9 to be provided for each bore 1. It is expedient if all the bores 1 are simultaneously provided with the enamel coating 2, it of course also being possible for this to take place in succession. Coating which is as simultaneous as possible is advantageous within the context of the heat treatment, however.

It is expedient if the entire bore 1 is provided with the enamel coating 2.

Then, provision is made to post-treat the coated bore 1, the enamel coating bonding to the base material of the bore metallurgically by phase formation. This post-treatment is combined with a heat treatment with subsequent quenching. The two treatments, i.e. the enamel firing operation and said heat treatment, proceed in the same temperature/time window, such that this firing and quenching operation thus gives rise to a cylinder block having an increased mechanical strength and also a cylinder bore with good thermal insulation and good wear and corrosion resistance. The heat treatment is expediently to be carried out as a bainitic gray cast iron heat treatment (AGI heat treatment=Austempered Gray Iron heat treatment).

Figure 4:
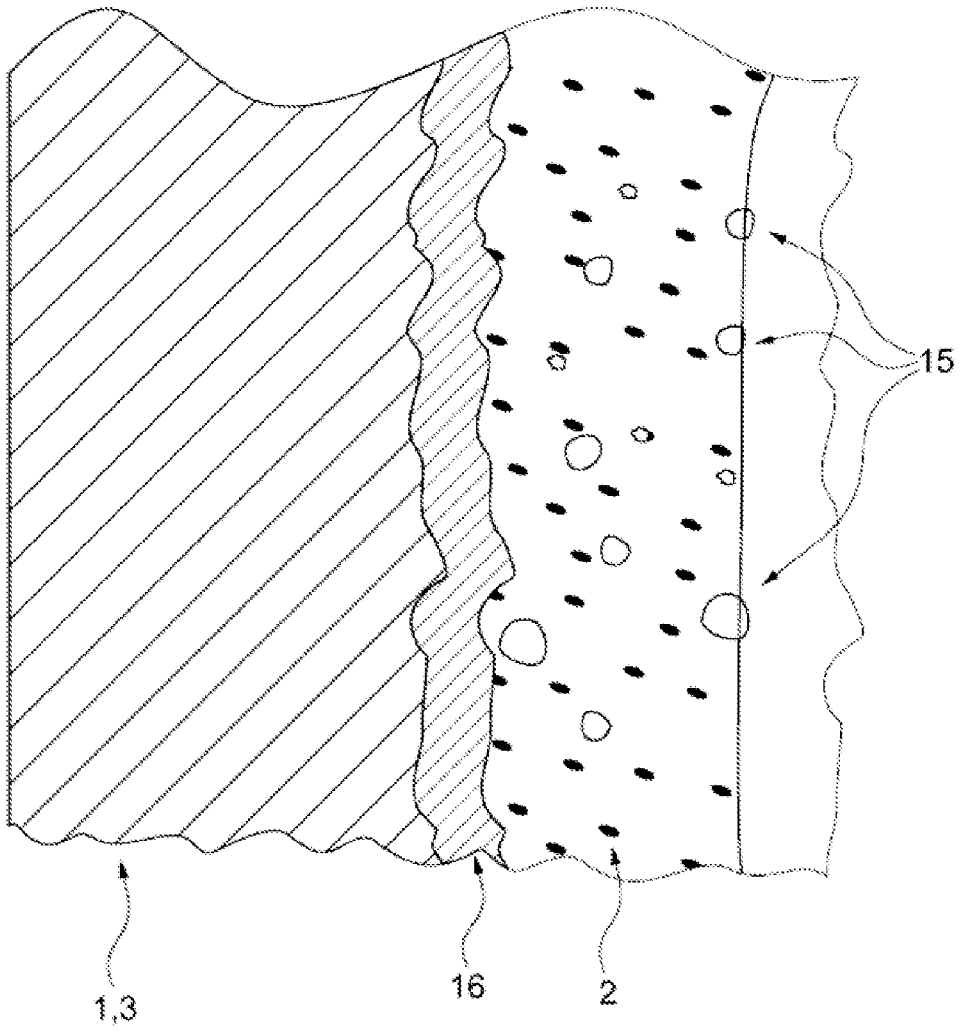
FIG. 4 shows a bore provided with the enamel coating in longitudinal section.

Then, the enamel coating 2 can be subjected to finishing, e.g. by means of diamond honing strips. In the process, the pores/air bubbles 15 present in the enamel coating 2 are cut and exposed, as can be seen in FIG. 4. FIG. 4 shows the inner surface 4 of the bore 1, the enamel coating 2 and also the transition zone 16 arranged therebetween. It can also be seen in FIG. 4 that said pores/air bubbles 15 are not pores or pore clusters which are connected to one another, as in the case of a sprayed coating applied thermally, and therefore a high hydrodynamic pressure can build up in the cut and exposed pores/air bubbles of the enamel coating according to the current application and the oil film cannot be pressed away into connected pores by the piston ring.

Figure 5:
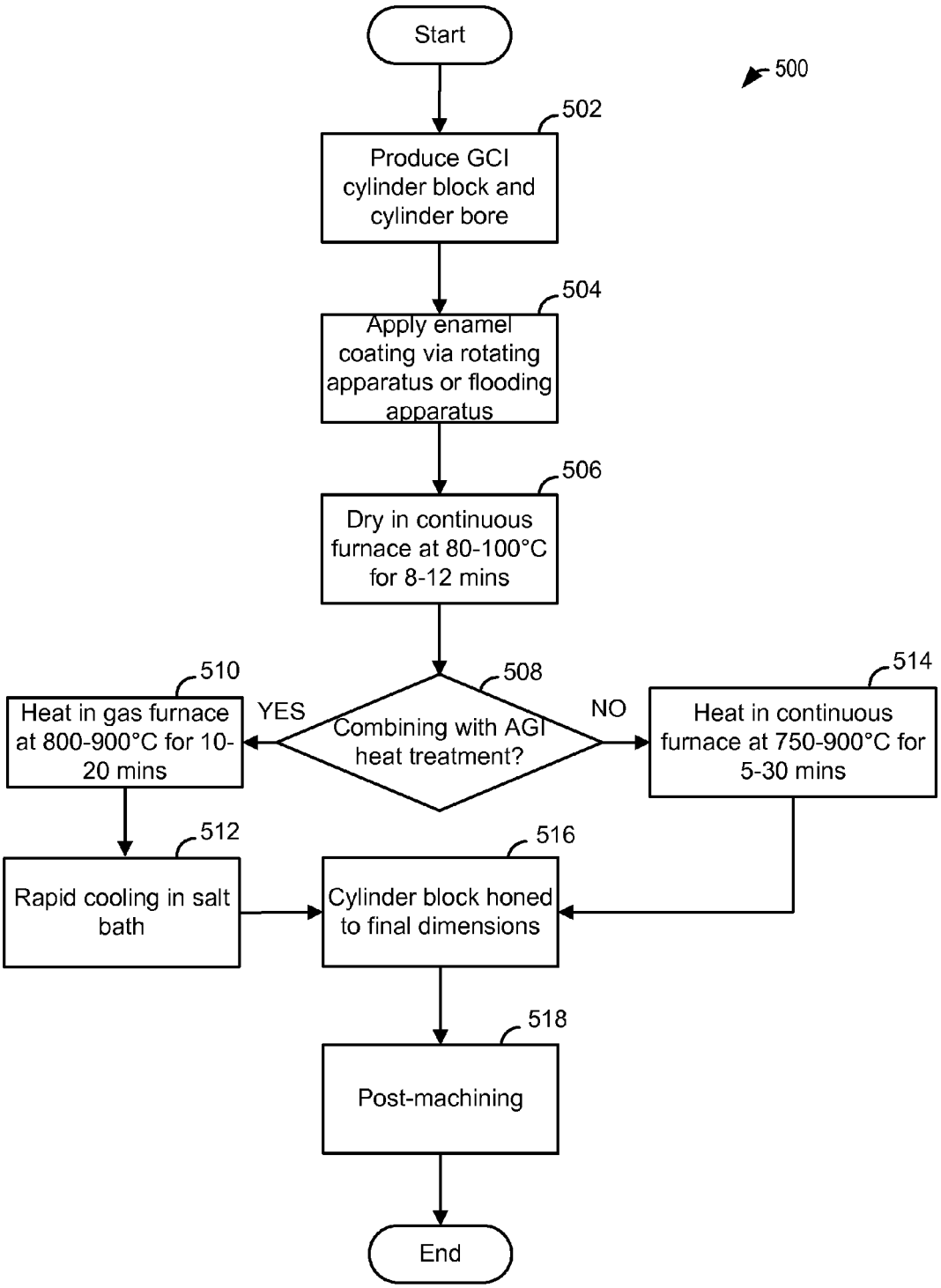
FIG. 5 shows an example method of producing an enamel coating in a gray cast iron cylinder block.

Turning now to FIG. 5, an example flowchart method of producing a gray cast iron cylinder block and cylinder bore with an enamel coating is shown. The method may include producing a cylinder as described in FIG. 1, coating with devices as described in FIGS. 2-3, resulting in an enamel coating as shown in FIG. 4, for example.

At 502, the method may include producing a gray cast iron cylinder block and cylinder bore. For example, this may including producing a main body, i.e. cylinder block, present in a blank and drilling a bore or bores in the body. Specifically, the main body may be produced by a sand casting method, and the bore(s) drilled in the cylinder block may be drilled out to have a 1-2 mm oversized diameter by a finish-boring method. For example, after OP10 machining, the cylinder bores may be pre-machined with a diameter that is 1-2 mm larger than the final honed diameter. Further, the inner-bore surface may be provided with a roughness of Ra 6 to 7 μm by turning spindles.

At 504, an enamel coating, such as the one described in FIG. 1, may be applied to the inner surface of the cylinder bore of the cylinder block produced at 502 at a thickness of greater than 500 μm. In another example the thickness of the enamel coating may be between 500-1000 μm. The enamel coating may be applied by the rotating apparatus of FIG. 2 or the flooding apparatus of FIG. 3, for example. The enamel coating may be applied as an aqueous suspension in a plurality of phases, or layers. Furthermore, the enamel coating may be provided over the entire circumference and vertical extent of the cylinder bore. The enamel coating may be provided simultaneously to each of the bores of the cylinder block or in a successive order.

At 506, the enamel coating as applied in 504 may be dried at a temperature of 80-100° C. for 8 to 12 minutes. In one example the enamel coating is dried at 90° C. for 10 minutes. The enamel coating may be dried in a continuous furnace. In another example, the enamel coating may be dried by a radiant heater or an induction coil. Further, after the enamel coating is dried, another layer of enamel coating may be applied according to the method at 504, and then dried by the aforementioned methods, so that the enamel coating comprises a plurality of phases or layers of up to 1000 μm in thickness, specifically 500-1000 μm. Alternatively, the enamel coating may comprise a single layer of up to 1000 μm in thickness, specifically 500-1000 μm. In another example, the enamel coating may comprise multiple layers each 500-1000 μm in thickness.

Next, at 508, the method includes deciding whether the cast gray iron cylinder block is desired to undergo an austempered gray iron heat treatment. This decision may be based on production costs and the properties of AGI versus GCI, for example. Austempered gray iron may have improved mechanical properties over conventional gray cast iron, such as an increased mechanical/fatigue strength, increased wear resistance, and increased ease of machining.

If yes at 508, the method proceeds to 510 where the dried enamel coating and cylinder block are heated at 800-900° C. for 10-20 minutes, which may correspond to the austentizing temperature of gray cast iron. Additionally, at this temperature range, the dried enamel coating may sinter, or anneal, metallurgically bonding to the base material of the cylinder block in phase formation. For example, the enamel coating may metallurgically bond to the now austempered gray iron of the cylinder block , producing a coating that provides thermal insulation, wear, and friction resistance, with a cylinder block of the improved mechanical properties of AGI, in an advantageously combined, economical processing step. This unexpected combination of treatments is due to the surprising finding that the enamel sintering process and AGI heat treatment process may proceed in similar temperature and time ranges.

At 512, the cylinder block with cylinder bores coated with the enamel is rapidly cooled, in a salt bath, for example. This quenching helps finish the processing of the AGI material, e.g., determines the final hardness of the material, prevents the formation of pearlite, etc.

At 516, the cylinder block may be honed to final dimensions and finish-machined.

At 518, post-machining/finishing may include a final treatment to the surface of the enamel coating after the firing step. For example, a layer of scale which may form from the annealing process as a result of the oxidation of the enamel's surface may be removed by machining In another example, the enamel coating may be finished by diamond honing strips, such that the air bubbles/pores of the enamel are cut and exposed, as shown in FIG. 4. Further, the cylinder bore may be post-machined by post-grinding, in which case it is possible to use diamond or hard material cup wheels, for example. In another example, post-machining may include hollow turning or finish-boring, which is feasible in spite of the high hardness on account of the brittleness, with preference being given to PCD (polycrystalline diamond) indexable inserts. The method may then end.

Returning to 508, if no, then the method proceeds to 514. The enamel coating may be sintered/annealed in a continuous furnace at 750-900° C. for 5-30 minutes. As in 510, treatment of the coated cylinder bore may cause the enamel coating to metallurgically bond by phase formation to the base material or substrate of the cylinder bore. For example, the enamel coating may bond to the GCI substrate material of the cylinder bore/walls. Afterwards, the method proceeds with 516 and 518 as described above, and may then end. The method is not limited to the above order. For example, the cylinder block and bore as treated in 514 to anneal the enamel coating in a continuous furnace may still undergo additional heat treatment and rapid cooling as described in 510 and 512 if desired.

Figure 6:
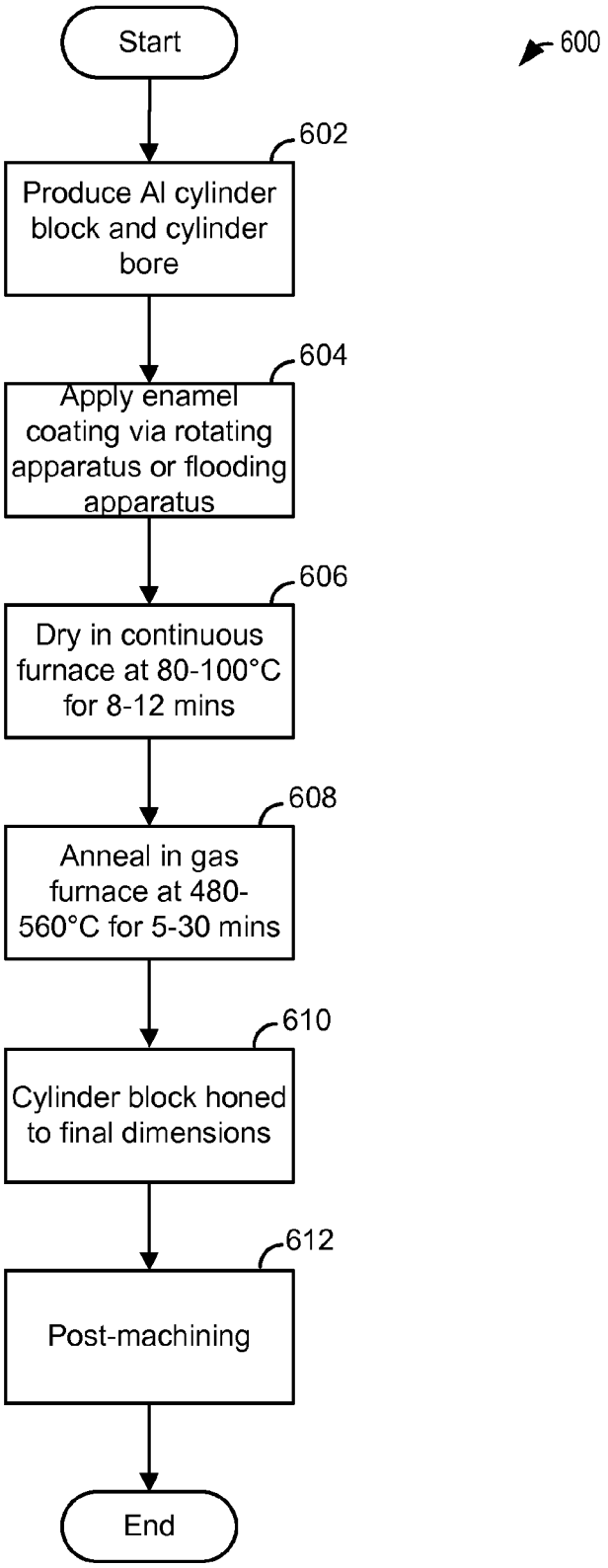
FIG. 6 shows an example method of producing an enamel coating in an aluminum cylinder block.

FIG. 6 provides a method flowchart much like FIG. 5, but with the parameters associated with an aluminum cylinder block. As such, the method in FIG. 6 involves similar steps to those described in FIG. 5 and therefore their above descriptions apply herein.

At 602, an aluminum block with bores may be produced. In one example, the aluminum may be an aluminum alloy. Further, the aluminum block may be produced by high pressure die casting (HDPC) in a vacuum to avoid blistering, for example.

At 604, an enamel coating, such as the one described in FIG. 1, may be applied to the inner surface of the cylinder bore of the cylinder block produced at 602 by the rotating apparatus of FIG. 2 or the flooding apparatus of FIG. 3, for example. Further, the thickness parameters of the layer(s) described above in FIG. 5 at 504 may apply here.

At 606, the enamel coating may be dried at a temperature of 80-100° C. for 8 to 12 minutes. In one example the enamel coating is dried at 90° C. for 10 minutes. The enamel coating may be dried in a continuous furnace. In another example, the enamel coating may be dried by a radiant heater or an induction coil. As described in FIG. 5, the enamel coating may be dried in layers.

Next, at 608, the enamel coating is annealed with the cylinder body for 5 to 30 minutes in a continuous furnace, for example, at a temperature between 480° C. to 560° C. In one example, the enamel coating is heated to 540° C. This temperature ranges allows the enamel coating to bond to the base material of the bore metallurgically by phase formation. For example, the enamel coating may be metallurgically bonded to the aluminum alloy of the cylinder block.

At 610, the cylinder block may be honed to final dimensions, and at 612, the final finishing/post-machining steps may occur. The procedure may then end.

The present disclosure provides for a system and method of coating the inner surface of a cylinder bore in an internal combustion engine. The coating comprises of enamel, wherein the enamel may have cobalt, manganese or nickel oxides to provide a stronger bond to metal substrates. Further, the enamel is applied via a rotating or flooding apparatus, not through a plasma spray, thermal spray, or electroplating method. Further still, this method allows for a thermal coating to metallurgically bond to cast gray iron or austempered gray iron without the need for a costly NiAl adhesive layer. The enamel coating may also provide additional mechanical strength to cylinder bores that comprise cast gray iron. Moreover, the enamel annealing process and the conversion of cast gray iron to austempered gray iron may be economically combined to form a cylinder block of improved mechanical properties and a cylinder bore that is thermally insulated and corrosive-resistant with an enamel coating.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for producing a coated bore of an internal combustion engine, said method comprising:

producing a main body present in a blank;

drilling out a bore and pre-machining the bore;

applying an enamel coating to an inner surface of the bore; and post-treating the coated bore, the enamel coating bonding to a base material of the bore metallurgically by phase formation;

wherein applying the enamel coating further comprises applying the enamel coating to the inner surface as an aqueous enamel slip and drying the inner surface in a continuous furnace at T=80° C. to 100° C. for 8 to 12 minutes; and wherein the main body is fed together with the dried enamel coating to a heating apparatus, in which the main body is heated to a temperature of 800° C. to 900° C. and is kept at this temperature for 10 to 20 minutes, this being followed by rapid cooling.

2. The method as claimed in claim 1, wherein drilling out the bore and pre-machining the bore further comprise drilling out the bore to an oversize of 1 to 2 mm in diameter via finish-boring.

3. The method as claimed in claim 1, further comprising providing the bore with a roughness of Ra 6 to 7 μm on the inner surface thereof by turning spindles.

4. The method as claimed in claim 1, wherein the enamel coating is applied by a rotating application apparatus.

5. The method as claimed in claim 1, wherein the enamel coating is applied in a dipping operation with a flooding apparatus, the flooding apparatus having at least one chamber which has at least one outlet opening and a feed opening, which is adjoined by a line, such that the aqueous enamel slip, which enters into the bore emerging from the outlet opening from the chamber, is introduced into the chamber.

6. The method as claimed in claim 1, wherein an entirety of the inner surface of the bore is provided with the enamel coating.

7. A cylinder block of an internal combustion engine, comprising:

a bore having an enamel coated inner surface, wherein the enamel coating is bonded together with the bore made of a gray cast iron material for 5 to 30 minutes in a continuous furnace at a temperature of between 750° C. and 900° C., such that the enamel coating bonds to the gray cast iron material of the bore metallurgically by phase formation.

8. The cylinder block as claimed in claim 7, wherein the enamel coating comprises at least one of glass-forming oxides selected from the group consisting of $SiO_2$, $B_2O_3$, $Na_2O$, $K_2O$, and $Al_2O_3$, and wherein the gray cast iron material of the bore is an austempered gray cast iron.

9. The cylinder block of claim 7, wherein the enamel coating is 500-1000 μm in thickness.

10. The cylinder block of claim 7, wherein the enamel coating comprises multiple layers.

11. The cylinder block of claim 7, wherein the enamel coating comprises pores that are cut and exposed, and wherein the pores are disconnected.

* * * * *